US007449270B2

(12) United States Patent
Kim et al.

(10) Patent No.: US 7,449,270 B2
(45) **Date of Patent: *Nov. 11, 2008**

(54) ELECTROPHOTOGRAPHIC PHOTORECEPTOR CONTAINING NAPHTHALENETETRACARBOXYLIC ACID DIIMIDE DERIVATIVES AS ELECTRON TRANSPORT MATERIALS IN CHARGE GENERATING LAYER AND THE ELECTROPHOTOGRAPHIC IMAGING APPARATUS USING THE PHOTORECEPTOR

(75) Inventors: Beom-jun Kim, Yongin-si (KR); Seung-ju Kim, Suwon-si (KR); Saburo Yokota, Suwon-si (KR); Kyung-yol Yon, Scongnam-si (KR); Moto Makino, Suwon-si (KR); Hwan-koo Lee, Suwon-si (KR); Ji-uk Kim, Gunpo-si (KR); Ji-Young Lee, Suwon-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 20 days.

This patent is subject to a terminal disclaimer.

(21) Appl. No.: 11/450,324

(22) Filed: Jun. 12, 2006

(65) Prior Publication Data

US 2006/0281020 A1 Dec. 14, 2006

(30) Foreign Application Priority Data

Jun. 13, 2005 (KR) ..... 10-2005-0050495

(51) Int. Cl.
*G03G 5/06* (2006.01)
*G03G 5/047* (2006.01)

(52) U.S. Cl. ..... 430/59.5; 430/59.1; 430/78; 399/159

(58) Field of Classification Search ..... 430/58.5, 430/78, 59.5, 59.1; 399/159
See application file for complete search history.

(56) References Cited

U.S. PATENT DOCUMENTS

| | | | | |
|---|---|---|---|---|
| 5,468,583 | A * | 11/1995 | Gruenbaum et al. | 430/58.5 |
| 6,022,656 | A | 2/2000 | Visser et al. | |
| 6,586,148 | B1 | 7/2003 | Graham et al. | |
| 2005/0019685 | A1 * | 1/2005 | Kim et al. | 430/78 |
| 2005/0130051 | A1 * | 6/2005 | Kim et al. | 430/78 |
| 2005/0227156 | A1 * | 10/2005 | Kim et al. | 430/78 |

FOREIGN PATENT DOCUMENTS

| | | |
|---|---|---|
| JP | 2000-047409 | 2/2000 |
| JP | 2000-113504 | 4/2000 |
| JP | 2004-269441 | 9/2004 |
| KR | 10-2004-0110662 | 12/2004 |

* cited by examiner

*Primary Examiner*—Christopher RoDee
(74) *Attorney, Agent, or Firm*—Roylance, Abrams, Berdo & Goodman, L.L.P.

(57) ABSTRACT

A two-layered electrophotographic photoreceptor is formed. The two-layered electrophotographic photoreceptor includes an electrically conductive substrate and a charge generating layer and a charge transporting layer form on the electrically conductive substrate, wherein the charge generating layer is a naphthalenetetracarboxylic acid diimide derivative represented by:

The two-layered electrophotographic photoreceptor has high photosensitivity and low residual potential.

9 Claims, 2 Drawing Sheets

ELECTROPHOTOGRAPHIC PHOTORECEPTOR CONTAINING NAPHTHALENETETRACARBOXYLIC ACID DIIMIDE DERIVATIVES AS ELECTRON TRANSPORT MATERIALS IN CHARGE GENERATING LAYER AND THE ELECTROPHOTOGRAPHIC IMAGING APPARATUS USING THE PHOTORECEPTOR

CROSS-REFERENCE TO RELATED PATENT APPLICATION

This application claims the benefit of Korean Patent Application No. 10-2005-0050495, filed on Jun. 13, 2005, in the Korean Intellectual Property Office, the disclosure of which is incorporated herein by reference in its entirety.

BACKGROUND OF THE INVENTION

1. Field of the Invention

The present invention relates to an electrophotographic photoreceptor and an electrophotographic imaging apparatus using the photoreceptor. More particularly, the invention relates to an electrophotographic photoreceptor which includes naphthalenetetracarboxylic acid diimide derivatives as an electron transporting material in a charge generating layer to enhance electrostatic properties such as photosensitivity and exposure potential, and an electrophotographic imaging apparatus employing the same.

2. Description of the Related Art

In electrophotography, for example, laser printers and copy machines, an electrophotographic photoreceptor includes a photosensitive layer formed on an electrically conductive substrate, and can be in the form of a plate, a disk, a sheet, a belt, or a drum, etc. In an electrophotographic photoreceptor, a surface of the photosensitive layer is first electrostatically charged uniformly, and then the charged surface is exposed to a pattern of light, thus forming an image. The light exposure selectively dissipates the charge in the exposed regions where the light strikes the surface, thereby forming a pattern of charged and uncharged regions, which is referred to as a latent image. Then, a wet or dry toner is applied in the vicinity of the latent image, and toner droplets or particles deposit in either the charged or uncharged regions to form a toner image on the surface of the photosensitive layer. The resulting toner image can be transferred and fixed to a suitable ultimate or intermediate receiving surface, such as paper, or the photosensitive layer can function as the ultimate receptor for receiving the image.

Electrophotographic photoreceptors are generally categorized into two types. The first has a two-layered type that includes a charge generating layer having a binder resin and a charge generating material (CGM), and a charge transporting layer having a binder resin and a charge transporting material (mainly, a hole transporting material (HTM)). In general, the laminated type electrophotographic photoreceptor is used in the fabrication of a negative (−) type electrophotographic photoreceptor. The other type is a single layered type in which a binder resin, a CGM, an HTM, and an electron transporting material (ETM) are contained in a single layer. In general, the single layered type photoreceptor is used in the fabrication of a positive (+) type electrophotographic photoreceptor.

The charge generating material generates charge carriers, that is holes and/or electrons upon light exposure. The charge transporting material contains at least one of the charge carriers and transports them through a charge transporting layer in order to easily discharge the surface charge of a photoreceptor.

For the charge generating layer in the two-layered type electrophotographic photoreceptor, the amount of the charge generating material is generally abundant to form an electrophotographic photoreceptor having high photosensitivity. However, when the amount of the charge generating material is too high, the stability of the coating slurry for forming the charge generating layer deteriorates so that the coating quality for the charge generating layer may be degraded, and the adhesion between the charge generating layer and an electrically conductive substrate, and the adhesion between the charge generating layer and the charge transporting layer may be degraded. On the contrary, when the amount of the charge generating material is too small, the stability of the coating slurry for forming the charge generating layer, the coating quality for the charge generating layer, the adhesion between the charge generating layer and an electrically conductive substrate, and the adhesion between the charge generating layer and the charge transporting layer are improved, but electrostatic properties of the electrophotographic photoreceptor are drastically deteriorated, for example, the degradation of the photosensitivity of the electrophotographic photoreceptor and the increase of exposure potential. In addition, regardless of the amount of the charge generating material in the charge generating layer, electrons are not smoothly transported through the charge generating layer so that the electrostatic properties of the electrophotographic photoreceptor are liable not to be fully exhibited, for example, low photosensitivity and high exposure potential of the electrophotographic photoreceptor. In particular, the degradation of the electrostatic properties due to the difficulty of the electron transportation in the charge generating layer is more serious when the thickness of the charge generating layer is increased in order to obtain high photosensitivity because charges are mainly generated at the upper portion of the charge generating layer.

To solve these problems, electrophotographic photoreceptors are disclosed in U.S. Pat. Nos. 5,547,790, 5,571,648, and 5,677,094.

U.S. Pat. No. 5,547,790 discloses an electrophotographic photoconductor comprising an electroconductive support and a photoconductive layer formed thereon. The photoconductive layer includes at least a charge generation layer comprising a charge generating material selected from the group consisting of azo pigments, perinone pigments and squaraines. The photoconductive layer also includes a polymeric charge transporting material, and a charge transport layer comprising a polymeric charge transporting material. The polymeric charge transporting material in said charge generation layer is selected from the group consisting of polysilylene, a polymer having a hydrazone structure on the main chain and/or side chain thereof, and a polymer having a tertiary amine structure on the main chain and/or side chain thereof. The polymeric charge transporting material in said charge transport layer is selected from the group consisting of polysilylene, a polymer having a hydrazone structure on the main chain and/or side chain thereof, and a polymer having a tertiary amine structure on the main chain and/or side chain thereof.

U.S. Pat. No. 5,571,648 discloses an electrophotographic imaging member comprising a support substrate having a two electrically conductive ground plane layers comprising a layer of zirconium over a layer of titanium, a hole blocking layer, an adhesive layer comprising a copolyester film forming resin, and an intermediate layer in contact with said adhesive layer. The intermediate layer is a film forming carbazole polymer. A charge generation layer is also provided comprising perylene or a phthalocyanine particles dispersed in a film forming polymer binder blend of polycarbonate and carbazole polymer. A hole transport layer is provided that is substantially non-absorbing in the spectral region at which the charge generation layer generates and injects photogenerated holes but being capable of supporting the injection of photogenerated holes from the charge generation layer and transporting said holes through the charge transport layer.

U.S. Pat. No. 5,677,094 discloses an electrophotographic photoconductor comprising an electroconductive support and a photoconductive layer formed on the electroconductive support and including a charge generation layer and a charge transport layer. The charge generation layer is a first polymeric charge transporting material having an ionization potential of 6.0 eV or less. The charge transport layer is a charge transporting small molecule and a binder.

In the electrophotographic photoreceptors disclosed in the above-described US Patents, the hole transporting material is further included in the charge generating layer in addition to the charge generating material to improve the electrostatic properties thereof. However, the electrostatic properties of the electrophotographic photoreceptor should be further improved.

SUMMARY OF THE INVENTION

The present invention provides an electrophotographic photoreceptor having improved coating quality, adhesion, and electrostatic properties.

The present invention also provides an electrophotographic imaging apparatus, an electrophotographic cartridge, and an electrophotographic drum employing the electrophotographic photoreceptor.

According to an aspect of the present invention, a two-layered electrophotographic photoreceptor is provided comprising:

an electrically conductive substrate; and a charge generating layer and a charge transporting layer formed on the electrically conductive substrate, wherein the charge generating layer comprises a naphthalenetetracarboxylic acid diimide derivative represented by Formula 1:

(1)

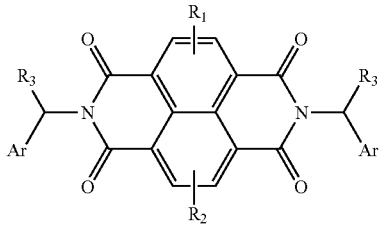

where $R_1$ and $R_2$ are independently a hydrogen atom, a halogen atom, a $C_1$-$C_{20}$ substituted or unsubstituted alkyl group, or a $C_1$-$C_{20}$ substituted or unsubstituted alkoxy group; $R_3$ is a $C_1$-$C_{20}$ substituted or unsubstituted alkyl group, a $C_1$-$C_{20}$ substituted or unsubstituted alkoxy group, a $C_7$-$C_{30}$ substituted or unsubstituted aralkyl group, or a $—(CH_2)_n—Y—R_4$ group; Ar is a $C_6$-$C_{30}$ substituted or unsubstituted aryl group; Y is an oxygen atom, sulfur atom, or NH; $R_4$ is a hydrogen atom, or a $C_1$-$C_{20}$ substituted or unsubstituted alkyl group; and n is an integer from 1 to 12.

According to another aspect of the present invention, an electrophotographic imaging apparatus is provided comprising:

an electrophotographic photoreceptor comprising an electrically conductive substrate and a charge generating layer and a charge transporting layer formed on the electrically conductive substrate, wherein the charge generating layer comprises a naphthalenetetracarboxylic acid diimide derivative represented by Formula 1.

According to still another aspect of the present invention, an electrophotographic cartridge is provided including an electrophotographic photoreceptor comprising an electrically conductive substrate, and a photosensitive layer formed on the electrically conductive substrate, wherein the charge generating layer comprises a naphthalenetetracarboxylic acid diimide derivative represented by Formula 1, and at least one device selected from the group consisting of a charging device that charges the electrophotographic photoreceptor, a developing device that develops an electrostatic latent image formed on the electrophotographic photoreceptor, and a cleaning device that cleans a surface of the electrophotographic photoreceptor, the electrophotographic cartridge being attachable to or detachable from the imaging apparatus.

The electrophotographic photoreceptor according to the present invention is a two-layered type electrophotographic photoreceptor, and further includes the naphthalenetetracarboxylic acid diimide derivative of Formula 1 in the charge generating layer formed of the charge generating material and the binder resin so that the coating quality, adhesion, and electrostatic properties of the charge generating layer are improved. The decrease in the amount of the charge generating material increases the stability of the coating slurry for the charge generating layer so that the coating quality and adhesion of the charge generating layer are improved. In addition, the electron transporting material besides the charge generating material is further included in the charge generating layer so that the electron transporting ability in the charge generating layer is improved. Accordingly, the electrostatic properties of the electrophotographic photoreceptor is improved.

These and other aspects of the invention will become apparent from the following detailed description of the invention and the drawings which disclose various embodiments of the invention.

BRIEF DESCRIPTION OF THE DRAWINGS

The above and other features and advantages of the present invention will become more apparent by describing in detail exemplary embodiments thereof with reference to the attached drawings in which.

DETAILED DESCRIPTION OF THE INVENTION

An electrophotographic photoreceptor according to the present invention and an electrophotographic imaging apparatus employing the same will now be described in detail.

Figure 1:
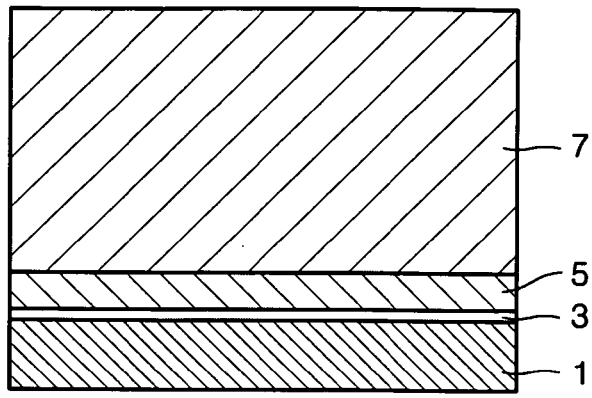
FIG. 1 is a schematic cross-sectional view of an electrophotographic photoreceptor according to an embodiment of the present invention. An electroconductive layer, a charge generating layer, and a charge transporting layer are shown sequentially stacked on an electrically conductive substrate.

FIG. 1 is a schematic cross-sectional view of an electrophotographic photoreceptor 100 according to an embodiment of the present invention. An electroconductive layer 3, a charge generating layer 5, and a charge transporting layer 7 are sequentially stacked on an electrically conductive substrate 1.

Figure 2:
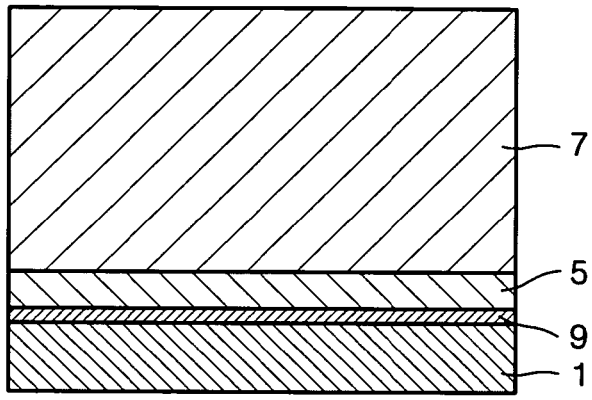
FIG. 2 is a schematic cross-sectional view of an electrophotographic photoreceptor according to another embodiment of the present invention. An intermediate layer, a charge generating layer, and a charge transporting layer are shown sequentially stacked on an electrically conductive substrate.

FIG. 2 is a schematic cross-sectional view of an electrophotographic photoreceptor 200 according to another embodiment of the present invention. An intermediate layer 9, a charge generating layer 5, and a charge transporting layer 7 are sequentially stacked on an electrically conductive substrate 1.

Figure 3:
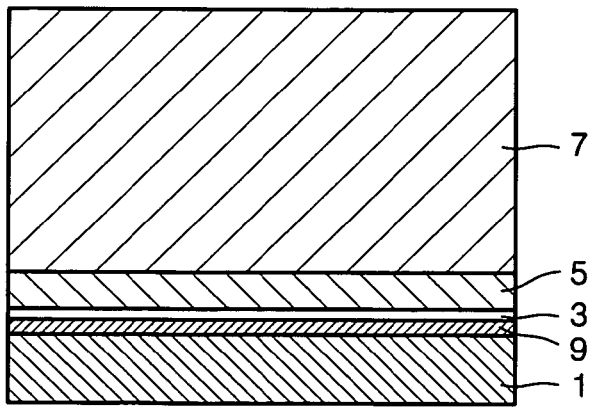
FIG. 3 is a schematic cross-sectional view of an electrophotographic photoreceptor according to another embodiment of the present invention. An intermediate layer, an electroconductive layer, a charge generating layer, and a charge transporting layer are shown sequentially stacked on an electrically conductive substrate.

FIG. 3 is a schematic cross-sectional view of an electrophotographic photoreceptor 300 according to another embodiment of the present invention. An intermediate layer 9, an electroconductive layer 3, a charge generating layer 5, and a charge transporting layer 7 are sequentially stacked on an electrically conductive substrate 1.

Referring to FIGS. 1 through 3, the electrophotographic photoreceptors according to the embodiments of the present invention have a two-layered structure in which the charge generating layer 5 and the charge transporting layer 7 are sequentially stacked as photosensitive layers on the electrically conductive substrate 1.

The electrically conductive substrate 1 can be formed of any electroconductive material, for example, metal or electrically conductive polymers, and is produced in the form of a plate, a disk, a sheet, a belt, or a drum. Examples of the metals include aluminum, vanadium, nickel, copper, zinc, palladium, indium, tin, platinum, stainless steel, chrome, and so forth. Examples of the polymers include polyester resin, polycarbonate resin, polyamide resin, polyimide resin, mixtures thereof, and a copolymer thereof in which an electrically conductive material is dispersed, such as electrically conductive carbon, tin oxide, and indium oxide. An organic polymer sheet formed by depositing or laminating a metal sheet or metal may be employed.

The electroconductive layer 3 and/or the intermediate layer 9 may be further formed on the electrically conductive substrate 1. The electroconductive layer 3 may be formed by dispersing conductive powders, for example, carbon black, graphite, metal powders, or metal oxide powders such as $TiO_2$, into a binder resin such as polyamide, polyester, and so forth. The thickness of the electroconductive layer 3 may be about 5 to 50 μm.

The intermediate layer 9 is formed to enhance adhesion or to prevent charges from being injected from the substrate. Examples of the intermediate layer 9 include an aluminum anodized layer; a resin-dispersed layer in which metal oxide powder such as titanium oxide or tin oxide is dispersed; and a resin layer such as polyvinyl alcohol, casein, ethylcellulose, gelatin, phenol resin, or polyamide, but the present invention is not limited thereto. The thickness of the intermediate layer may be about 0.05 to 5 μm.

The charge generating layer 5 and the charge transporting layer 7 are formed as a photosensitive layer on the electrically conductive substrate 1 of the two-layered electrophotographic photoreceptor of the present embodiment.

Examples of the CGM used in the charge generating layer include phthalocyanine-based pigments, azo-based compounds, bisazo-based compounds, triazo-based compounds, quinone-based pigments, perylene-based compounds, indigo-based compounds, bisbenzoimidazole-based pigments, anthraquinone-based compounds, quinacridone-based compounds, azulenium-based compounds, squarylium-based compounds, pyrylium-based compounds, triarylmethane-based compounds, cyanine-based compounds, perinone-based compounds, polycycloquinone compounds, pyrrolopyrrol compounds, naphthalocyanine compounds, amorphous silicone, amorphous selenium, trigonal selenium, tellurium, selenium-tellurium alloy, cadmium sulfide, antimony sulfide, and zinc sulfide. The CGM is not limited to the materials listed herein, and may be used alone or in combination of two or more. The CGM may be one of phthalocyanine-based pigments. Examples of the phthalocyanine-based pigments include titanyloxy phthalocyanine pigments, for example, D-type or Y-type titanyloxy phthalocyanine having the strongest diffraction peak at a Bragg angle (2θ±0.20°) of 27.1° in a powder X-ray diffraction pattern, β-type titanyloxy phthalocyanine having the strongest diffraction peak at a Bragg angle (2θ±0.2°) of 26.1°, or α-type titanyloxy phthalocyanine having the strongest diffraction peak at a Bragg angle (2θ±0.2°) of 7.5°; or metal-free phthalocyanine pigments, for example, X-type metal-free phthalocyanine having the strongest diffraction peak at a Bragg angle (2θ±0.2°) of 7.5° and 9.2° in a powder X-ray diffraction pattern or τ-type metal-free phthalocyanine. Since the phthalocyanine-based pigments have the best photosensitivity with respect to light having a wavelength ranging from 780 to 800 nm and the photosensitivity can be selected according to the crystal structures, the phthalocyanine-based pigments can be effectively employed in embodiments of the present invention.

The charge generating layer in the electrophotographic photoreceptor further includes an electron transporting material formed of a naphthalenetetracarboxylic acid diimide derivative represented by Formula 1.

(1)

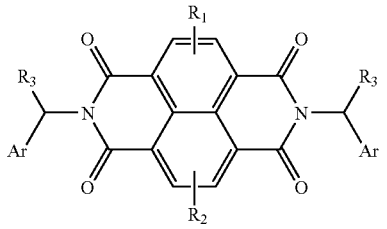

where $R_1$ and $R_2$ are independently a hydrogen atom, a halogen atom, a $C_1$-$C_{20}$ substituted or unsubstituted alkyl group, or a $C_1$-$C_{20}$ substituted or unsubstituted alkoxy group; $R_3$ is a $C_1$-$C_{20}$ substituted or unsubstituted alkyl group, a $C_1$-$C_{20}$ substituted or unsubstituted alkoxy group, a $C_7$-$C_{30}$ substituted or unsubstituted aralkyl group, or a $—(CH_2)_n—Y—R_4$ group; Ar is a $C_6$-$C_{30}$ substituted or unsubstituted aryl group; Y is an oxygen atom, sulfur atom, or NH; $R_4$ is a hydrogen atom, or a $C_1$-$C_{20}$ substituted or unsubstituted alkyl group; and n is an integer from 1 to 12.

The naphthalenetetracarboxylic acid diimide derivative of Formula 1 includes a branched alkyl group in which an aryl group is substituted for a carbon atom located at an a position with respect to the nitrogen atom of the imide bond, and is disclosed in a co-pending U.S. patent application Ser. No. 11/095,522 filed on 1 Apr. 2005 by the present applicants. The synthesizing method of the naphthalenetetracarboxylic acid diimide derivative of Formula 1 is disclosed in detail in the specification of the above-application. In the electrophotographic photoreceptor according to the present invention having the naphthalenetetracarboxylic acid diimide derivative in the charge generating layer as an electron transporting material, the coating quality, adhesion and electrostatic properties of the charge generating layer can be improved. The amount of the charge generating material can be reduced by the addition of the electron transporting material so that the agglomeration and precipitation of the charge generating material particles in the coating slurry for forming the charge generating layer can be reduced, and thus the coating quality of the charge generating layer can be improved. And, the amount of the binder resin can be increased without the decrease in the electrostatic properties so that the adhesion of the charge generating layer can be improved. According to the present invention, the electron transporting material besides the charge generating material is further included in the charge generating layer so that the electron transporting ability in the charge generating layer can be improved, thereby improving the electrostatic properties of the electrophotographic photoreceptor.

In particular, according to the present invention, the naphthalenetetracarboxylic acid diimide derivative of Formula 1 includes a branched alkyl group in which an aryl group is substituted on a carbon atom located at an α position with respect to the nitrogen atom of the imide bond, creating a more asymmetric structure, and thus has better solubility to an organic solvent and high compatibility with a binder resin compared with a conventional naphthalenetetracarboxylic acid diimide derivative in which an alkyl group is substituted on a carbon atom located at an α position with respect to the nitrogen atom of the imide bond so that the electron transporting ability in the charge generating layer can be effectively improved.

The halogen atom in Formula 1 may be fluorine, chlorine, bromine or iodine.

The alkyl group may be a $C_1$-$C_{20}$ linear or branched alkyl group, for example, a $C_1$-$C_{12}$ linear or branched alkyl group. Examples of the alkyl group include methyl, ethyl, n-propyl, isopropyl, n-butyl, isobutyl, sec-butyl, tert-butyl, pentyl, hexyl, 1,2-dimethyl-propyl, and 2-ethylhexyl. The alkyl group may be substituted with a halogen atom, such as fluorine, chlorine, bromine or iodine.

In Formula 1, the alkoxy group is a $C_1$-$C_{20}$ linear or branched alkoxy group, and, for example, a $C_1$-$C_{12}$ linear or branched alkoxy group. Examples of the alkoxy group include methoxy, ethoxy, and propoxy. The alkoxy group may be substituted with a halogen atom, such as fluorine, chlorine, bromine or iodine.

In Formula 1, aralkyl group is a $C_7$-$C_{30}$ linear or branched aralkyl group, and for example, a $C_7$-$C_{15}$ linear or branched aralkyl group. Examples of the aralkyl group include benzyl, methylbenzyl, phenylethyl, naphthylmethyl, and naphthylethyl. The aralkyl group may be substituted with a halogen atom, such as fluorine, chlorine, bromine or iodine, an alkyl group, an aryl group, an alkoxy group, a nitro group, a hydroxyl group, or a sulfonic acid group.

In Formula 1, $R_3$ may be a $—(CH_2)_n—Y—R_4$ group. Here, Y is oxygen atom sulfur atom, or NH; n is an integer from 1 to 12; and $R_4$ is a hydrogen atom or a $C_1$-$C_{20}$ substituted or unsubstituted alkyl group. Specific examples of the $—(CH_2)_n—Y—R_4$ group includes hydroxymethyl, hydroxyethyl, and $—CH_2—S—CH_3$.

The aryl group, which is indicated as Ar in Formula 1, is a $C_6$-$C_{30}$ aromatic ring. Examples of the aryl group include phenyl, tolyl, xylyl, biphenyl, o-terphenyl, naphthyl, anthracenyl, and phenanthrenyl. The aryl group may be substituted with an alkyl group, an alkoxy group, a nitro group, a hydroxyl group, or a sulfonic acid group or a halogen atom.

Specific examples of the naphthalenetetracarboxylic acid diimide derivatives having Formula 1 include the following compounds:

ETM-1

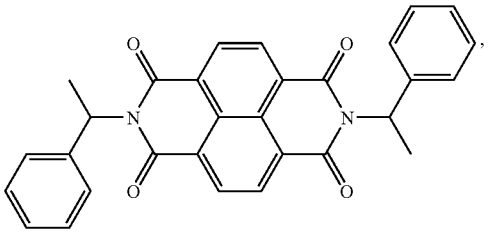

ETM-2

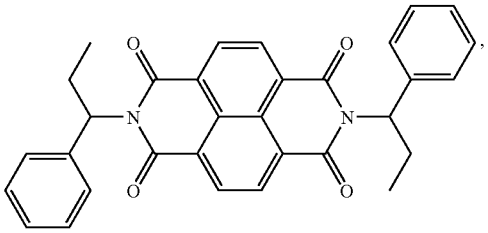

ETM-3

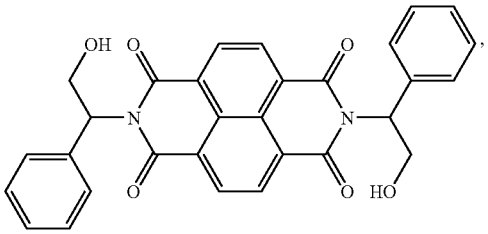

ETM-4

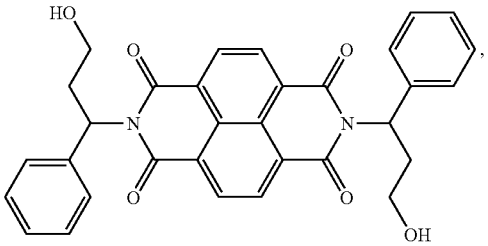

ETM-5

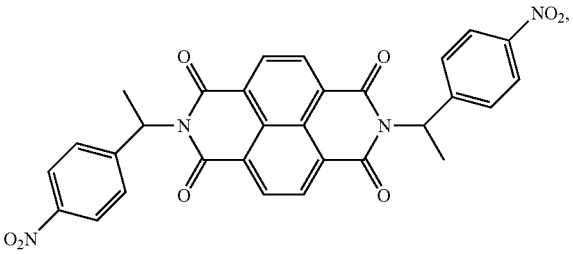

ETM-6

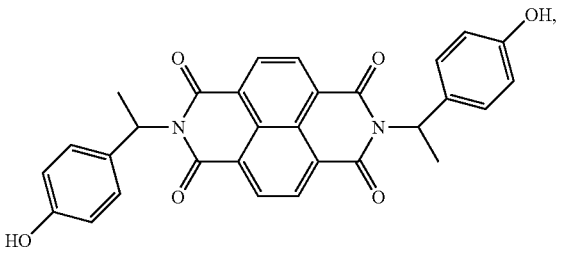

-continued
ETM-7
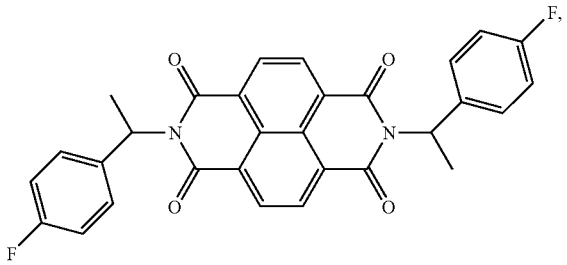
ETM-8
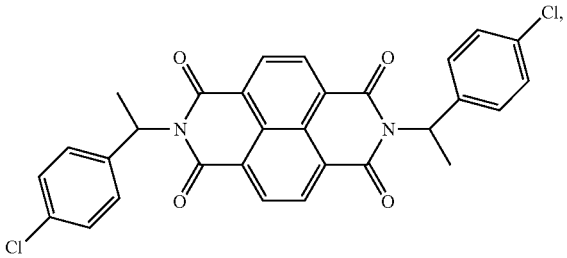
ETM-9
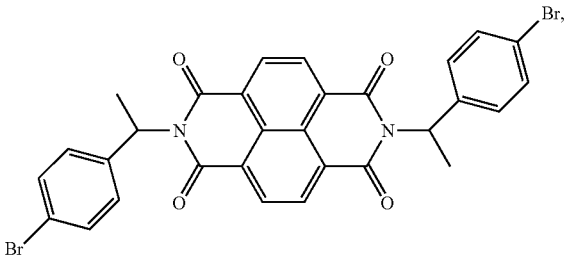
ETM-10
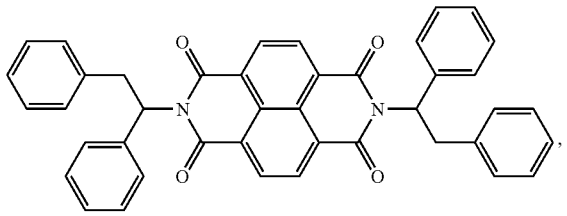
ETM-11
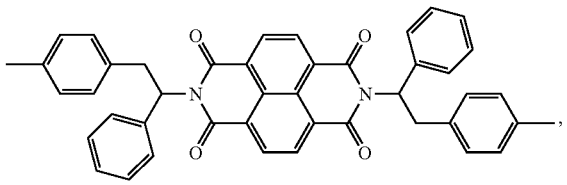
ETM-12
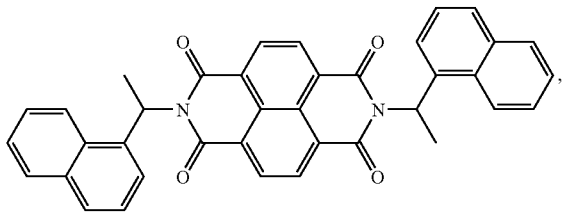
-continued
ETM-13
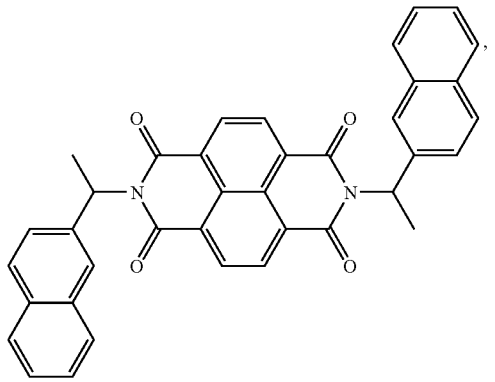
ETM-14
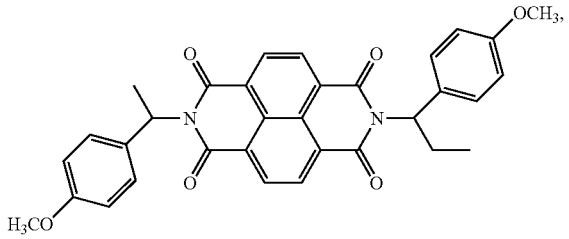
ETM-15
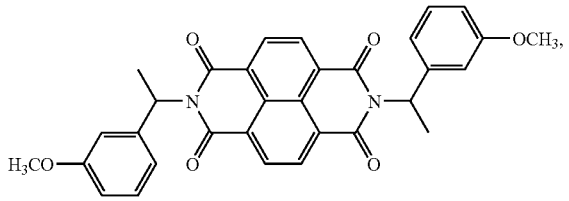
ETM-16
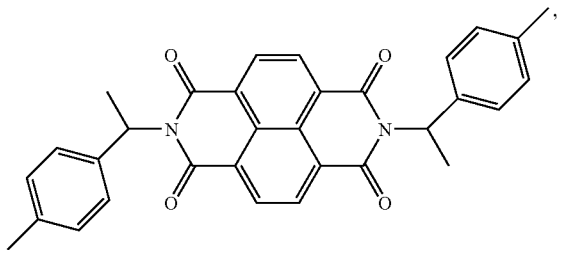
ETM-17
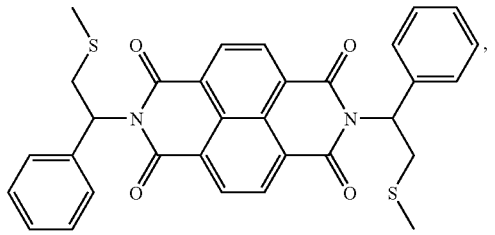

-continued

ETM-18

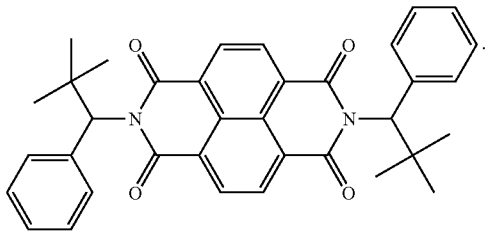

The amount of the electron transporting material of Formula 1 may be 5 to 50 parts by weight, for example, 10 to 40 parts by weight, with respect to 100 parts by weight of the charge generating material. When the amount of the electron transporting material is less than 5 parts by weight, the electron transporting material is not sufficient so that the residual potential is not decreased. When the amount of the electron transporting material is greater than 50 parts by weight, the charge generating material is not sufficient, the charges are not smoothly generated.

The charge generating material is dispersed in the binder resin of the charge generating layer. Examples of the binder resin used in the formation of the charge generating layer include, but are not limited to, polyvinyl butyral, polyvinyl acetal, polyester, polyamide, polyvinyl alcohol, polyvinyl acetate, polyvinyl chloride, polyurethane, polycarbonate, acrylic resin, methacryl resin, polyvinylidene chloride, polystyrene, styrene-butadiene copolymer, styrene-methyl methacrylate copolymer, vinylidene chloride-acrylonitrile copolymer, vinyl chloride-vinyl acetate copolymer, vinyl chloride-vinyl acetate-maleic anhydride copolymer, ethylene-acrylic acid copolymer, ethylene-vinyl acetate copolymer, methyl cellulose, ethyl cellulose, nitrocellulose, carboxymethyl cellulose, silicone resin, silicone-alkyd resin, phenol-formaldehyde resin, cresol-formaldehyde resin, phenoxy resin, styrene-alkyd resin, poly-N-vinylcarbazole resin, polyvinylformal, polyhydroxystyrene, norbornene resin, polycycloolefin, polyvinylpyrrolidone, poly(2-ethyl-oxazoline), polysulfone, melamine resin, urea resin, amino resin, isocyanate resin, and epoxy resin. These binder resins may be used alone or in combination of two or more.

The amount of the binder resin may be 5 to 350 parts by weight, for example, 10 to 200 parts by weight, with respect to 100 parts by weight of the charge generating material. When the amount of the binder resin is less than 5 parts by weight, the charge generating materials, such as phthalocyanine pigments, are not sufficiently dispersed so that the stability of the coating dispersion is lower, the charge generating layer is not uniformly formed when the dispersion is coated on the electrically conductive substrate, and the adhesion is deteriorated. When the amount of the binder resin is greater than 350 parts by weight, the charge potential cannot be maintained and the photosensitivity is not sufficient because of the excessive amount of the binder resin, and thus a desired image cannot be obtained.

The solvents used for preparing a coating slurry for forming the charge generating layer may be varied according to the type of the binder resin, and may preferably be selected in such a way that it does not affect adjacent layers of the charge generating layer. Examples of solvents include, but are not limited to, methyl isopropyl ketone, methyl isobutyl ketone, 4-methoxy-4-methyl-2-pentanone, isopropyl acetate, tertiary-butylacetate, isopropyl alcohol, isobutyl alcohol, acetone, methyl ethyl ketone, cyclohexanone, 1,2-dichloroethane, 1,1,2-trichloroethane, 1,1,1-trichloroethane, trichloroethylene, tetrachloroethane, dichloromethane, tetrahydrofuran, dioxane, dioxolan, methanol, ethanol, 1-propanol, 1-butanol, 2-butanol, 1-methoxy-2-propanol, ethylacetate, butylacetate, dimethylsulfoxide, methylcellosolve, butylamine, diethylamine, ethylenediamine, isopropanolamine, triethanolamine, triethylenediamine, N,N'-dimethylformamide, 1,2-dimethoxyethane, benzene, toluene, xylene, methylbenzene, ethylbenzene, cyclohexane, and anisole. These solvents may be used alone or in combination of two or more.

Next, a preparing method of the coating slurry for forming the charge generating layer will be described. First, 100 parts by weight of a charge generating material, for example phthalocyanine pigments such as titanyloxy phthalocyanine, 5 to 50 parts by weight, for example, 10 to 40 parts by weight, of the electron transporting material of Formula 1, and 5 to 350 parts by weight, for example, 10 to 200 parts by weight, of a binder resin is mixed with an appropriate amount of a solvent, for example, 100 to 10,000 parts by weight, such as 500 to 8,000 parts by weight. Glass beads, steel beads, zirconia beads, alumina beads, zirconia balls, alumina balls, or steel balls are added in the mixture and are dispersed using a dispersing apparatus for about 2 to 50 hours. A mechanical milling method can be used. The milling apparatus to be used is, for example, an attritor, a ball-mill, a sand-mill, a banburry mixer, a roll-mill, three-roll mill, nanomiser, microfluidizer, a stamp mill, a planetary mill, a vibration mill, a kneader, a homonizer, a dyno-mill, a micronizer, a paint shaker, a high-speed agitator, an ultimiser, or an ultrasonic homogenizer. The milling apparatuses may be used alone or in combination of two or more.

The coating slurry for forming the charge generating layer is coated on the above-described electrically conductive substrate. The coating method that may be used includes, for example, a dip coating method, a ring coating method, a roll coating method, and a spray coating method. The coated substrate is dried at about 90 to 200° C. for about 0.1 to 2 hours, thereby forming the charge generating layer.

The thickness of the charge generating layer may be 0.001 to 10 μm, for example, 0.01 to 10 μm, such as 0.05 to 3 μm. When the thickness of the charge generating layer is less than 0.001 μm, the charge generating layer is difficult to be uniformly form. When the thickness of the charge generating layer is greater than 10 μm, electrostatic properties tend to be degraded.

The charge transporting layer including a charge transporting material and a binder resin is formed on the charge generating layer.

The charge transporting materials are categorized into a hole transporting material and an electron transporting material. When the two-layered photoreceptor is employed as a negative (−) charge type, the hole transporting material is used as the charge transporting material. When both positive (+) and negative (−) charge properties are required, the hole transporting material and the electron transporting material can be simultaneously used. Examples of the HTM that may be used include nitrogen containing cyclic compounds or condensed polycyclic compounds such as hydrazone-based compounds, butadiene-based amine compounds, benzidine-based compounds including N, N'-bis-(3-methylphenyl)-N, N'-bis(phenyl)benzidine, N, N, N', N'-tetrakis(3-methylphenyl)benzidine, N, N, N', N'-tetrakis(4-methylphenyl)benzidine, N, N'-di(naphthalene-1-yl)-N, N'-di(4-methylphenyl) benzidine, and N, N'-di(naphthalene-2-yl)-N, N'-di(3-methylphenyl)benzidine, pyrene-based compounds, carbazole-based compounds, arylmethane-based compounds, thiazol-based compounds, styryl-based compounds, pyrazolin-based compounds, arylamine-based compounds, oxazole-based compounds, oxadiazole-based compounds, pyrazolin-based compounds, pyrazolone-based compounds, stilbene-based compounds, polyaryl alkane-based compounds and derivatives thereof, polyvinylcarbazole-based compounds and their derivatives, N-acrylamide methylcarbazole copolymers, triphenylmethane copolymers, styrene copolymers, polyacenaphthene, polyindene, copolymers of acenaphthylene and styrene, and formaldehyde-based condensed resin. Also, high molecular weight compounds having functional groups of the above compounds on a backbone or side chain may be used.

When the charge transporting layer includes an electron transporting material, the electron transporting material that may be used is not limited and may include any known electron transporting material. Specifically, examples of ETM that may be used in the present invention include electron attracting low-molecular weight compounds, for example, benzoquinone-based compounds, naphthoquinone-based compounds, anthraquinone-based compounds, malononitrile-based compounds, fluorenone-based compounds, cyanoethylene-based compounds, cyanoquinodimethane-based compounds, xanthone-based compounds, phenanthraquinone-based compounds, phthalic anhydride-based compounds, thiopyran-based compounds, dicyanofluorenone-based compounds, naphthalenetetracarboxylic acid diimide compounds including the compounds of Formula 1, benzoquinonimine-based compounds, diphenoquinone-based compounds, stilbene quinone-based compounds, diiminoquinone-based compounds, dioxotetracenedione compounds, and thiopyran-based compounds. Electron transporting polymer compounds or pigments having n-type semiconductor characteristic may also be used.

However, the charge transporting material that may be used in the present invention is not limited the above-described HTM and ETM. A material having a charge mobility higher than $10^{-8}$ $cm^2/V\cdot sec$ can be used. The charge transporting materials may be used alone or in combination of two or more.

When the charge transporting material itself can form a thin film, a charge transporting layer can be formed without using a binder resin. In general, low molecular materials cannot form a thin film by itself. Accordingly, composition for forming charge transporting layer having the charge transporting material dissolved or dispersed in a binder resin and a solvent is made, and the composition is coated on the charge generating layer and dried, thereby forming a charge transporting layer. Examples of the binder resin used in the formation of the charge transporting layer include, but are not limited to, an insulation resin, such as polyvinyl butyral, polyacrylates (condensed polymer of bisphenol A and phthalic acid, and so on), polycarbonate, polyester resin, phenoxy resin, polyvinyl acetate, acryl resin, methacryl resin, polyacryl amide resin, polyamide, polyvinyl pyridine, cellulose-based resin, urethane resin, epoxy resin, silicone resin, polystyrene, polyketone, polyvinyl chloride, vinyl chloride-vinylic acid copolymer, polyvinyl acetal, polyacrylonitrile, phenol resin, melamine resin, casein, polyvinyl alcohol, and polyvinyl pyrrolidone; and an organic photoconducting polymer, such as poly N-vinyl carbazole, polyvinyl anthracene, and polyvinyl pyrene.

The present inventors have found that a polycarbonate resin is preferable to be used as a binder resin for forming a charge transporting layer. In particular, polycarbonate-Z derived from cyclohexylidene bisphenol is preferable to polycarbonate-A derived from bisphenol A or polycarbonate-C derived from methylbisphenol-A because the high glass transition temperature and high abrasion resistance thereof can be used. The amount of the binder resin used may be 5 to 200 parts by weight, for example, 10 to 150 parts by weight, of the charge transporting material with respect to 100 parts by weight of the binder resin.

In the electrophotographic photoreceptor of the present invention, the charge transporting layer may include phosphate-based compounds, phosphine oxide-based compounds, or a combination thereof, and silicone oil for increasing the abrasion resistance and providing slippage characteristics to the surface of the charge transporting layer. The phosphate-based compounds that may be used in the present invention include, but are not limited to, for example, triphenyl phosphate, tricresyl phosphate, trioctyl phosphate, octyidiphenyl phosphate, trichloroethyl phosphate, cresyldiphenyl phosphate, tributyl phosphate, and tri-2-ethylhexyl phosphate. The phosphine oxide-based compounds that may be used in the present invention include, but are not limited to, for example, triphenyl phosphine oxide, tricresyl phosphine oxide, trioctyl phosphine oxide, octyidiphenyl phosphine oxide, trichloroethyl phosphine oxide, cresyldiphenyl phosphine oxide, tributyl phosphine oxide, and tri-2-ethylhexyl phosphine oxide.

The phosphate-based compounds and phosphine oxide-based compounds may be used alone or in combination of two or more. The amount thereof used may be 0.01 to 10 parts by weight, for example, 0.1 to 5 parts by weight with respect to 100 parts by weight of the binder resin in the charge transporting layer. When the amount is less than 0.01 parts by weight, the adhesion and durability are insignificantly improved. When the amount is greater than 10 parts by weight, the electrostatic properties tends to be degraded. When a combination of the phosphate-based compounds and the phosphine oxide-based compounds is used, the ratio of phosphate-based compounds to phosphine oxide-based compounds may be, for example, equal to 100: 0.1 to 100.

The silicone oil is used to increase the slippage of the charge transporting layer, thereby enhancing the abrasion resistance of the electrophotographic photoreceptor. Examples of the silicone oil that may be used in the present invention include, but are not limited to, polysiloxane oil, for example, straight silicone oil such as dimethylsilicone oil, methylphenyl silicone oil, and methylhydrogen silicone oil; and modified silicone oil in which an organic group is introduced in at least one of side chains or end groups of the straight silicone oil. Examples of the organic group include, for example, an amino group, an epoxy group, a carboxyl group, an alcohol group, a mercapto group, an alkyl group, a polyether group, a methylstyryl group, a higher fatty acid ester group, a fluoroalkyl group, a (meth)acryl group, and an alkoxy group. Specific examples of silicone oil that are commercially-available include, KF96, KF50, KF54, KP301, KP302, KP306, KP321, KP322, KP323, KP324, KP326, KP340, KP341, KP354, KP355, KP356, KP357, KP358, KP359, KP362, KP363, KP365, KP366, KP368, KP369, KP316, KP360, KP361, KP390, KP391, and KP392 which are brand names and manufactured by Shin-Etsu Chemical Co. Ltd. of Japan.

The amount of the silicone oil used may be 0.01 to 1 parts by weight, for example, 0.01 to 0.5 parts by weight, with respect to 100 parts by weight of the binder resin in the charge transporting layer. When the amount of the silicone oil is less than 0.01 parts by weight, the slippage is not significantly increased. When the amount of the silicone oil is greater than 1 parts by weight, the adhesion may be reduced. When the phosphate-based compounds and/or the phosphine oxide-based compounds are used together with the silicone oil, the abrasion resistance may further be enhanced due to the slippage increase of the surface of the charge transporting layer.

In the electrophotographic photoreceptor according to the present invention, the solvent used for preparing the coating solution for forming the charge transporting layer may be varied according to the type of the binder resin, and may preferably be selected in such a way that it does not affect the charge generating layer which lies below. Specifically, the solvent may be, for example, aromatic hydrocarbons such as benzene, xylene, ligroin, monochlorobenzene, and dichlorobenzene; ketones such as acetone, methyl ethyl ketone, and cyclohexanone; alcohols such as methanol, ethanol, and isopropanol; esters such as methyl acetate, ethyl acetate and methyl cellosolve; halogenated aliphatic hydrocarbons such as carbon tetrachloride, chloroform, dichloromethane, dichloroethane, and trichloroethylene; ethers such as tetrahydrofuran, dioxane, dioxolan, ethylene glycol, and monomethyl ether; amides such as N,N-dimethyl formamide, N,N-dimethyl acetamide; and sulfoxides such as dimethyl sulfoxide. These solvents may be used alone or in combination of two or more.

A preparing method of the coating solution for forming the charge transporting layer will be described.

100 parts by weight of a binder resin, 5 to 200 parts by weight of a charge transporting material, optionally 0.01 to 10 parts by weight of phosphate-based compounds and/or phosphine oxide-based compounds, optionally 0.01 to 1 parts by weight of silicone oil, and an appropriate amount of a solvent, for example 100 to 1, 500 parts by weight, for example, 300 to 1, 200 parts by weight are mixed and agitated.

The coating solution for forming the charge transporting layer thus prepared is coated on the previously formed charge generating layer. The coating methods that may be used include, for example, a dip coating method, a ring coating method, a roll coating method, and a spray coating method. The coated substrate is dried at about 90 to 200° C. for about 0.1 to 2 hours, thereby forming the charge transporting layer on the charge generating layer.

The thickness of the charge transporting layer may be 2 to 100 μm, for example, 5 to 50 μm, such as 10 to 40 μm. When the thickness of the charge transporting layer is less than 2 μm, the thickness is too thin to provide sufficient durability. When the thickness of the charge transporting layer is greater than 100 μm, the physical abrasion resistance tends to increase but the printing quality tends to be degraded.

The electrophotographic photoreceptor of the present invention may further include at least one additive selected from an antioxidant, an optical stabilizer, a plasticizer, a leveling agent, and a dispersion stabilizing agent in the charge transporting layer and/or charge generating layer in order to increase the stability with respect to environment or harmful light.

Examples of the antioxidant include any known antioxidant, for example, hindered phenol-based compounds, sulfur-based compounds, esters of phosphonic acid, esters of hypophosphoric acid, and amine-based compounds, but are not limited thereto. Examples of the optical stabilizer include any known optical stabilizer, for example, benzotriazole-based compounds, benzophenone-based compounds, and hindered amine-based compounds, but are not limited thereto.

The electrophotographic photoreceptor according to an embodiment of the present invention may further include a surface protecting layer, if necessary.

Hereinafter, an electrophotographic imaging apparatus, a electrophotographic drum, and an electrophotographic cartridge employing the electrophotographic photoreceptor including a charge generating layer having naphthalenetetracarboxylic acid diimide derivative of Formula 1 will now be described. First, the electrophotographic imaging apparatus will be described.

Figure 4:
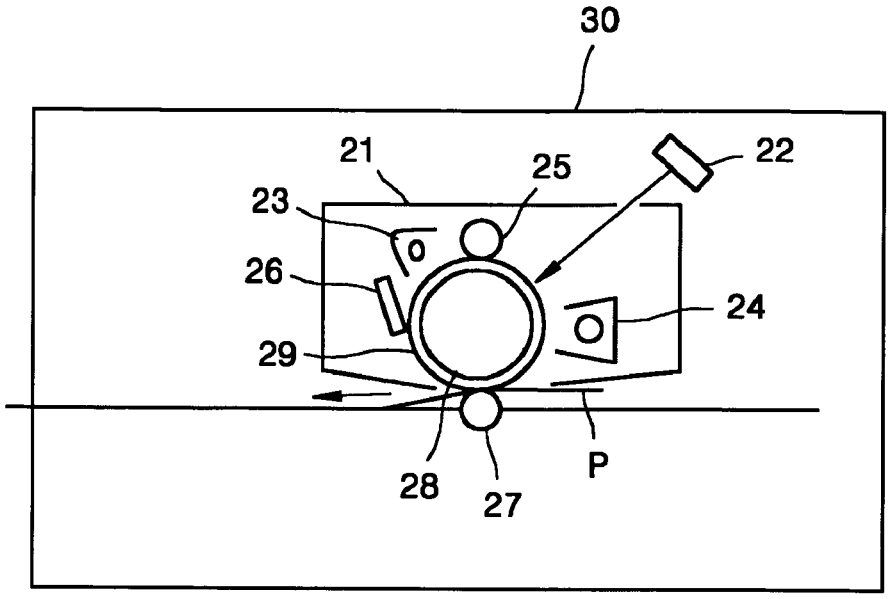
FIG. 4 is a schematic representation of an imaging apparatus, an electrophotographic drum, and an electrophotographic cartridge in accordance with an embodiment of the present invention.

FIG. 4 schematically illustrates an image forming apparatus 30 including an electrophotographic photoreceptor drum 28, 29 and an electrophotographic cartridge 21 according to an embodiment of the present invention. The electrophotographic cartridge 21 typically includes an electrophotographic photoreceptor 29, one or more charging devices 25 for charging the electrophotographic photoreceptor 29, a developing device 24 for developing an electrostatic latent image formed on the electrophotographic photoreceptor 29, and a cleaning device 26 for cleaning a surface of the electrophotographic photoreceptor 29. The electrophotographic cartridge 21 can be attached to and detached from the image forming apparatus 30.

The electrophotographic photoreceptor drum 28, 29 of the image forming apparatus 30 can generally be attached to and detached from the image forming apparatus 30 and includes the drum 28 on which the electrophotographic photoreceptor 29 is placed.

Generally, the image forming apparatus 30 includes a photosensitive unit (for example, the drum 28 and the electrophotographic photoreceptor 29); the charging device 25 for charging the photoreceptor unit; an irradiating device 22 for irradiating image-forming light onto the charged photoreceptor unit to form an electrostatic latent image on the photoreceptor unit; the developing unit 24 for developing the electrostatic latent image with a toner to form a toner image on the photoreceptor unit; and a transfer device 27 for transferring the toner image onto a receiving material, such as paper P, and the photoreceptor unit includes the electrophotographic photoreceptor 29, which will be described below. The charging device 25 may be supplied with a voltage as a charging unit and may charge the electrophotographic photoreceptor 29. The image forming apparatus 30 may also include a pre-exposure unit 23 to erase residual charge on the surface of the electrophotographic photoreceptor 29 to prepare for a next cycle.

The electrophotographic photoreceptor including the naphthalenetetracarboxylic acid diimide derivative of Formula 1 according to the present invention may be incorporated into electrophotographic imaging apparatuses such as a laser printer, a photocopier, and a facsimile.

Hereinafter, the present invention will be described in more detail with reference to the following examples. However, these examples are given for the purpose of illustration and are not intended to limit the scope of the invention.

EXAMPLE 1

2 parts by weight of the compound ETM-1 as an electron transporting material, 20 parts by weight of titanyloxy phthalocyanine (y-TiOPc) as a charge generating material, 13 parts by weight of polyvinyl butyral binder resin Compound 2 (PVB 6000-C, Denka), and 635 parts by weight of tetrahydrofuran (THF) were sand milled for 2 hours and uniformly dispersed using ultrasonic waves. The obtained solution was coated on an anodized aluminum drum (anodic oxide layer thickness: 5 μm) having a diameter of 30 mm using a ring bar and dried at 120° C. for 20 minutes to form a charge generating layer (CGL) having a thickness of about 0.5 μm.

45 parts by weight of enaminestilbene-based Compound 3 as an HTM, and 55 parts by weight of polycarbonate Z binder resin Compound 4 (PCZ200, Mitsubishi Gas Chemical) were dissolved in 426 parts by weight of THF/toluene cosolvent (weight ratio=4/1) to obtain a solution, which was used to form a charge transporting layer. The obtained solution was coated on the CGL formed on the anodized aluminum drum and dried at 120° C. for 30 minutes to form a charge transporting layer (CTL) having a thickness of about 20 μm.

EXAMPLE 2

An electrophotographic photoreceptor drum was prepared in the same manner as in Example 1, except that the amount of the compound ETM-1 was adjusted to 5 parts by weight.

EXAMPLE 3

An electrophotographic photoreceptor drum was prepared in the same manner as in Example 1, except that the amount of the compound ETM-1 was adjusted to 7 parts by weight.

EXAMPLE 4

An electrophotographic photoreceptor drum was prepared in the same manner as in Example 1, except that the compound ETM-2 was used instead of the compound ETM-1.

EXAMPLE 5

An electrophotographic photoreceptor drum was prepared in the same manner as in Example 2, except that the compound ETM-2 was used instead of the compound ETM-1.

EXAMPLE 6

An electrophotographic photoreceptor drum was prepared in the same manner as in Example 3, except that the compound ETM-2 was used instead of the compound ETM-1.

COMPARATIVE EXAMPLE 1

20 parts by weight of titanyloxy phthalocyanine (y-TiOPc) as a charge generating material, 18 parts by weight of polyvinyl butyral binder resin Compound 2 (PVB 6000-C, Denka), 635 parts by weight of THF were sand milled for 2 hours and uniformly dispersed using ultrasonic waves. The obtained solution was coated on an anodized aluminum drum (anodic oxide layer thickness: 5 μm) having a diameter of 30 mm using a ring bar and dried at 120° C. for 20 minutes to form a charge generating layer (CGL) having a thickness of about 0.5 μm.

45 parts by weight of enaminestilbene-based Compound 3 as an HTM, and 55 parts by weight of polycarbonate Z binder resin Compound 4 (PCZ200, Mitsubishi Gas Chemical) were dissolved in 426 parts by weight of THF/toluene cosolvent (weight ratio=4/1) to obtain a solution, which was used to form a charge transporting layer. The obtained solution was coated on the CGL formed on the anodized aluminum drum and dried at 120° C. for 30 minutes to form a charge transporting layer (CTL) having a thickness of about 20 μm.

COMPARATIVE EXAMPLE 2

An electrophotographic photoreceptor drum was prepared in the same manner as in Comparative Example 1, except that the amount of the polyvinyl butyral binder was adjusted to 13 parts by weight.

COMPARATIVE EXAMPLE 3

An electrophotographic photoreceptor drum was prepared in the same manner as in Example 1, except that 5 parts by weight of the compound 5 was used instead of the compound ETM-1.

The compositions and amounts of each component of the photoreceptors of Examples 1 through 6 and Comparative Examples 1 through 3 are summarized in Table. 1.

1

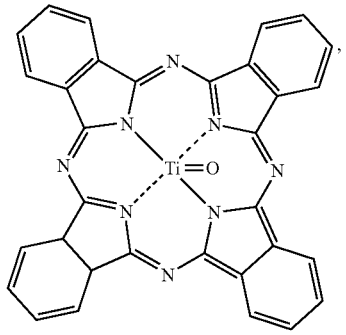

2

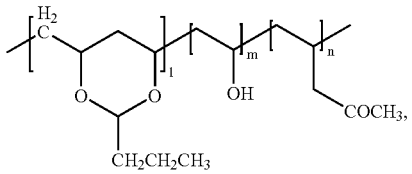

1:m:n = 81:17:2

3

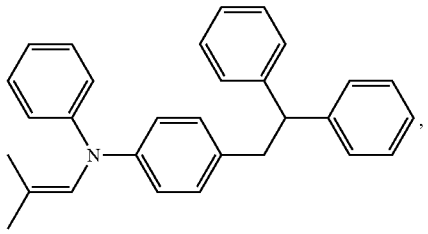

4

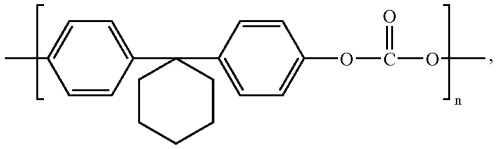

5

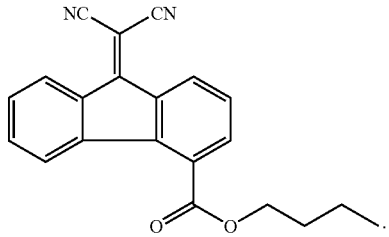

Electrostatic Property Test

The electrostatic property (the electrophotographic property) of each of the electrophotographic photoreceptors manufactured in Examples 1-6 and Comparative Examples 1-3 was measured using an apparatus for estimating the electrostatic property ("PDT-2000", available from QEA Co.) at 23° and a relative humidity of 50%.

As a measure of the photosensitivity of the electrophotographic photoreceptors, the light exposure energy $E_{1/2}$ required for the surface potential of a photoreceptor to be a half of an initial potential, and the light exposure energy $E_{200}$ required for the surface potential of a photoreceptor to be 200V were measured. And, in order to measure residual potentials of the electrophotographic photoreceptors, the surface potential $E_{0.25}$ of a photoreceptor when irradiated with light exposure energy of 0.25 μJ/cm$^2$ and the surface potential $E_{0.5}$ of a photoreceptor when irradiated with light exposure energy of 0.5 μJ/cm$^2$ were measured. In the above test, monochromatic light having a wavelength of 780 nm was used.

Table 2 shows the results of the electrostatic property measurements.

TABLE 1

| | Type of CGM | Amount of CGM (parts by weight) | Amount of binder resin (parts by weight) | Type of ETM | Amount of ETM (parts by weight) |
|---|---|---|---|---|---|
| Example 1 | y-TiOPc | 20 | 13 | ETM-1 | 2 |
| Example 2 | y-TiOPc | 20 | 13 | ETM-1 | 5 |
| Example 3 | y-TiOPc | 20 | 13 | ETM-1 | 7 |
| Example 4 | y-TiOPc | 20 | 13 | ETM-2 | 2 |
| Example 5 | y-TiOPc | 20 | 13 | ETM-2 | 5 |
| Example 6 | y-TiOPc | 20 | 13 | ETM-2 | 7 |
| Comparative Example 1 | y-TiOPc | 20 | 18 | — | — |
| Comparative Example 2 | y-TiOPc | 20 | 13 | — | — |
| Comparative Example 3 | y-TiOPc | 20 | 13 | compound 5 | 5 |

TABLE 2

| | $E_{1/2}$ (μJ/cm$_2$) | $E_{200}$ (μJ/cm$_2$) | $E_{0.25}$ (V) | $E_{0.5}$ (V) |
|---|---|---|---|---|
| Example 1 | 0.097 | 0.158 | 72 | 31 |
| Example 2 | 0.094 | 0.155 | 65 | 26 |
| Example 3 | 0.095 | 0.156 | 65 | 25 |
| Example 4 | 0.096 | 0.159 | 71 | 32 |
| Example 5 | 0.095 | 0.154 | 66 | 25 |
| Example 6 | 0.095 | 0.155 | 65 | 26 |
| Comparative Example 1 | 0.098 | 0.162 | 104 | 57 |
| Comparative Example 2 | 0.099 | 0.160 | 79 | 35 |
| Comparative Example 3 | 0.104 | 0.187 | 112 | 65 |

$E_{1/2}$ is the light exposure energy required for the surface potential of a photoreceptor to be a half of the initial potential;

$E_{200}$ is the light exposure energy required for the surface potential of a photoreceptor to be 200V;

$E_{0.25}$ is the surface potential of a photoreceptor when light exposure energy of 0.25 μJ/cm$^2$ is irradiated; and $E_{0.5}$ is the surface potential of a photoreceptor when light exposure energy of 0.5 μJ/cm$^2$ is irradiated.

Referring to Table 2, Examples 1 through 6 show lower $E_{12}$, $E_{200}$, $E_{0.25}$, and $E_{0.5}$ than Comparative Examples 1 through 3. Accordingly, the electrophotographic photoreceptors of Examples 1 through 6 according to the present invention have higher photosensitivities and lower residual potentials than those of Comparative Examples 1 through 3. Specifically, when Examples 1 through 6 in which the naphthalenetetracarboxylic acid diimide derivative of Formula 1 (ETM-1 and ETM-2), was added as an ETM to the charge generating layer, are compared with Comparative Examples 1 and 2 in which the ETM was not added, all of $E_{1/2}$, $E_{200}$, $E_{0.25}$, and $E_{0.5}$ were lower. In particular, for the cases of $E_{0.25}$ and $E_{0.5}$, the differences are further significant. As described above, this is because the naphthalenetetracarboxylic acid diimide derivative of Formula 1 added to the charge generating layer may rapidly and smoothly transport electrons generated in the charge generating material to the electrically conductive substrate, and help to inject electrons from the charge generating layer to the electrically conductive substrate.

For Comparative Example 3 in which the compound 5 was added as an ETM, the electrostatic properties were deteriorated compared with Comparative Examples 1 and 2 in which the electron transporting materials were not added. The results of Comparative Example 3 shows that the naphthalenetetracarboxylic acid diimide derivative of Formula 1 effectively increases the photosensitivity of the two-layered photoreceptor, and effectively decreases the residual potential.

As described above, the two-layered electrophotographic photoreceptor according to the present invention in which the naphthalenetetracarboxylic acid diimide derivative of Formula 1 is included as an electron transporting material in the charge generating layer have excellent electrostatic properties such as high photosensitivity and low residual potential. This is because the naphthalenetetracarboxylic acid diimide derivative of Formula 1 added to the charge generating layer may rapidly and smoothly transport electrons generated in the charge generating material to the electrically conductive substrate, and help to inject electrons from the charge generating layer to the electrically conductive substrate.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A two-layered electrophotographic photoreceptor comprising:

an electrically conductive substrate; and a charge generating layer and a charge transporting layer formed on the electrically conductive substrate, wherein the charge generating layer includes an electron transporting material which comprises a naphthalenetetracarboxylic acid diimide derivative represented by:

(1)

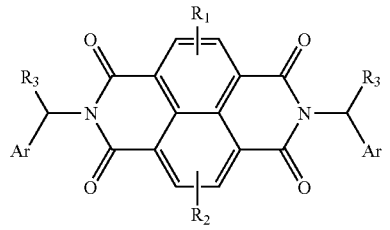

wherein $R_1$ and $R_2$ are hydrogen atoms, $R_3$ is methyl, ethyl, propyl, butyl, pentyl, benzyl, or methylbenzyl, and Ar is phenyl, nitrophenyl, hydroxyphenyl, halophenyl, methoxyphenyl, methylphenyl, naphthyl, anthracenyl, or phenanthrenyl.

2. The electrophotographic photoreceptor of claim 1, wherein the charge generating layer further comprises titanyloxy phthalocyanine-based charge generating material.

3. The electrograph photoreceptor of claim 1, wherein the charge generating layer further comprises one or more charge generating materials.

4. An electrophotographic imaging apparatus comprising:

a two layered electrophotographic photoreceptor comprising an electrically conductive substrate and a charge generating layer and a charge transporting layer formed on the electrically conductive substrate, wherein the charge generating layer includes an electron transporting material which comprises a naphthalenetetracarboxylic acid diimide derivative represented by:

(1)

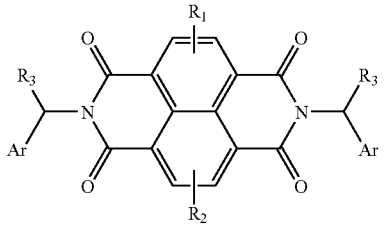

wherein $R_1$ and $R_2$ are hydrogen atoms, $R_3$ is methyl, ethyl, propyl, butyl, pentyl, benzyl, or methylbenzyl, and Ar is phenyl, nitrophenyl, hydroxyphenyl, halophenyl, methoxyphenyl, methylphenyl, naphthyl, anthracenyl, or phenanthrenyl.

5. The electrophotographic imaging apparatus of claim 4, wherein the charge generating layer comprises titanyloxy phthalocyanine-based charge generating material.

6. The electrograph imaging apparatus of claim 4, wherein the charge generating layer further comprises one or more charge generating materials.

7. An electrophotographic cartridge comprising:

an electrophotographic photoreceptor comprising an electrically conductive substrate and a charge generating layer and a charge transporting layer formed on the electrically conductive substrate, wherein the charge generating layer includes an electron transporting material which comprises a naphthalenetetracarboxylic acid diimide derivative represented by:

(1)

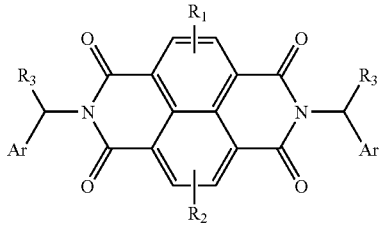

wherein $R_1$ and $R_2$ are hydrogen atoms, $R_3$ is methyl, ethyl, propyl, butyl, pentyl, benzyl, or methylbenzyl, and Ar is phenyl, nitrophenyl, hydroxyphenyl, halophenyl, methoxyphenyl, methylphenyl, naphthyl, anthracenyl, or phenanthrenyl, and at least one selected from the group consisting of a charging device that charges the electrophotographic photoreceptor, a developing device that develops an electrostatic latent image formed on the electrophotographic photoreceptor, and a cleaning device that cleans a surface of the electrophotographic photoreceptor, the electrophotographic cartridge being attachable to or detachable from the imaging apparatus.

8. The electrophotographic cartridge of claim 7, wherein the charge generating layer further comprises titanyloxy phthalocyanine-based charge generating material.

9. The electrophotographic cartridge if claim 7, wherein the charge generating layer further comprises one or more charge generating materials.

* * * * *